US009711857B2

(12) United States Patent
Lo Hine Tong et al.

(10) Patent No.: US 9,711,857 B2
(45) Date of Patent: Jul. 18, 2017

(54) MULTI-BAND ANTENNA

(71) Applicant: THOMSON LICENSING, Issy de Moulineaux (FR)

(72) Inventors: Dominique Lo Hine Tong, Rennes (FR); Philippe Minard, Saint Medard sur Ille (FR); Jean-Luc Robert, Betton (FR)

(73) Assignee: THOMSON LICENSING, Issy les Moulineaux (FR)

( * ) Notice: Subject to any disclaimer, the term of this patent is extended or adjusted under 35 U.S.C. 154(b) by 0 days.

(21) Appl. No.: 14/880,710

(22) PCT Filed: Apr. 10, 2014

(86) PCT No.: PCT/EP2014/057315
§ 371 (c)(1),
(2) Date: Oct. 12, 2015

(87) PCT Pub. No.: WO2014/167072
PCT Pub. Date: Oct. 16, 2014

(65) Prior Publication Data

US 2016/0294062 A1 Oct. 6, 2016

(30) Foreign Application Priority Data

Apr. 12, 2013 (EP) ..... 13305482

(51) Int. Cl.
*H01Q 5/00* (2015.01)
*H01Q 9/04* (2006.01)
(Continued)

(52) U.S. Cl.
CPC ..... *H01Q 9/0421* (2013.01); *H01Q 1/2291* (2013.01); *H01Q 1/48* (2013.01);
(Continued)

(58) Field of Classification Search
CPC ..... H01Q 1/38; H01Q 1/243; H01Q 9/0421; H01Q 1/2291; H01Q 9/42; H01Q 21/30; H01Q 5/40; H01Q 1/48
See application file for complete search history.

(56) References Cited

U.S. PATENT DOCUMENTS 7,218,282 B2 * 5/2007 Humpfer ..... H01Q 1/38 343/700 MS
7,274,334 B2 * 9/2007 O'Riordan ..... H01Q 1/243 343/700 MS (Continued)

FOREIGN PATENT DOCUMENTS

| | | |
|---|---|---|
| CN | 201845856 | 5/2011 |
| EP | 1848061 | 10/2007 |
| EP | 1860732 | 11/2007 |

OTHER PUBLICATIONS

Rhyu etal: "Multi-band-hybrid-antenna for ultra-thin mobile phone Applications"; Electronics Letters, Jul. 16, 2009, vol. 45, No. 15; pp. 1-2.

(Continued)

*Primary Examiner* — Dieu H Duong
(74) *Attorney, Agent, or Firm* — Brian J. Dorini; Patricia A. Verlangieri

(57) ABSTRACT

The present invention relates to multi-band antenna. This antenna comprises a substrate and at least one conductive layer provided with a plurality of antennas, such as PIFAs, resonating in specific frequency bands. The antennas are cascaded in order to achieve a compact antenna. The first antenna comprises a first radiating element, a first feed element connected to said first radiating element and a first ground return element and the second antennas comprises a second radiating element, a second feed element connected to said second radiating element and a second ground return element. The ground plane is printed in the same layer as the first or second antenna.

16 Claims, 12 Drawing Sheets

(51) Int. Cl.

| | |
|---|---|
| ***H01Q 1/22*** | (2006.01) |
| ***H01Q 9/42*** | (2006.01) |
| ***H01Q 21/30*** | (2006.01) |
| ***H01Q 5/40*** | (2015.01) |
| ***H01Q 1/48*** | (2006.01) |

(52) U.S. Cl.
CPC ..... *H01Q 5/40* (2015.01); *H01Q 9/42* (2013.01); *H01Q 21/30* (2013.01)

(56) References Cited

U.S. PATENT DOCUMENTS

| | | | | |
|---|---|---|---|---|
| 7,280,074 | B1 | 10/2007 | Chi et al. | |
| 7,324,054 | B2 | 1/2008 | Ozkar | |
| 7,358,902 | B2 | 4/2008 | Erkocevic | |
| 2002/0186169 | A1* | 12/2002 | Iwai | H01Q 9/0414 343/702 |
| 2004/0246188 | A1 | 12/2004 | Egashira | |
| 2007/0096992 | A1 | 5/2007 | Fujil et al. | |
| 2007/0182636 | A1 | 8/2007 | Carlson et al. | |
| 2009/0278755 | A1 | 11/2009 | Shoji et al. | |
| 2011/0309985 | A1* | 12/2011 | He | H01Q 1/38 343/700 MS |
| 2015/0061951 | A1* | 3/2015 | Wong | H01Q 1/243 343/749 |

OTHER PUBLICATIONS

International Search Report Dated Jul. 2, 2014.
European Search Report Dated Sep. 11, 2013.

* cited by examiner

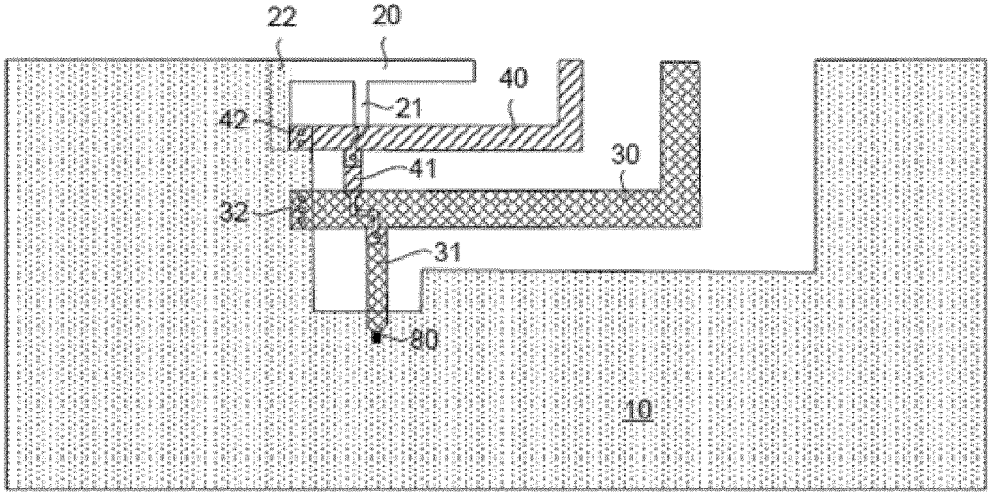
Fig.20
Fig.21
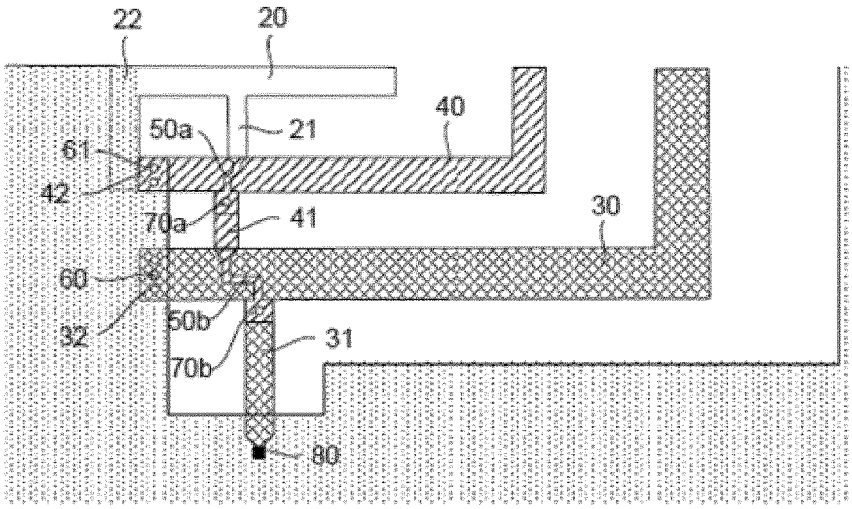

MULTI-BAND ANTENNA

This application claims the benefit, under 35 U.S.C. §365 of International Application PCT/EP2014/057315, filed Apr. 10, 2014, which was published in accordance with PCT Article 21(2) on Oct. 16, 2014 in English and which claims the benefit of European patent application No. 13305482.5, filed Apr. 12, 2013.

TECHNICAL FIELD OF THE INVENTION

The present invention relates generally to a multiband antenna for wireless communication systems, for example for home-networking devices or mobile devices.

BACKGROUND OF THE INVENTION

Home-networking devices, such as gateways and set-top-boxes, needs to be compatible with more and more wireless standards. These standards are for example: WLAN (Wireless Local Area Network) operating in the 2.4 GHz and 5 GHz band, Bluetooth and RF4CE (Radio Frequency For Consumer Electronics) operating in the 2.4 GHz band, DECT (Digital Enhanced Cordless telecommunications) operating in the 1900 MHz band, and LTE (Long Term Evolution) operating in the UHF and L bands.

This demand of devices compatible with a plurality of wireless standards increases the number of requested antennas and subsequently increases the cost of devices. The demand of MIMO systems increases also the number of antennas. For a n-order MIMO system, n antennas are needed. In addition, the demand of radiation diversity for systems like RF4CE or DECT systems contributes also to this increase.

Different antenna architectures are possible for these multiband wireless systems. FIG. 1A to FIG. 1C illustrate three possible antenna architectures.

FIG. 1A shows a first antenna architecture comprising, for each requested band, a specific single band antenna and a specific filter. This solution is very costly since it requests a connector between each antenna and each filter.

FIG. 1B shows a second antenna architecture comprising a single wide band antenna and a specific filter for each requested band. In this architecture, the frequency bandwidth in which the antenna is well impedance-matched should cover all the frequency bands of the multiband system. A multiplexer is used in order to direct the signals towards the different filters and the associated transceivers. This solution is relatively cheap as it requests only one connector and one multiplexer. However, depending on the targeted frequency bandwidth, the design of this kind of antenna could be very tricky and could result in a trade-off solution between the size and the performances (return loss, gain, efficiency etc.). In addition, the wide band antenna can increase EMI issues because of its wide band gain.

FIG. 1C shows a third antenna architecture comprising a multi-band antenna and a specific filter for each requested band. With this kind of antenna, the antenna return loss response is multi-band. This means that the antenna is only well matched in the targeted frequency bands. This solution is low cost solution since it uses only one connector and one multiplexer.

The present invention has been devised with the foregoing in mind

SUMMARY OF THE INVENTION

According to a first aspect of the invention there is provided a multi-band antenna comprising a substrate having at least one conductive layer; said at least one conductive layer comprising a ground section; a first radiating element, a first feed element (31) connected to said first radiating element and a first ground return element (32) connected to said first radiating element and said ground section, said first radiating element (30) and said first feed element (31) being offset transversally from the ground section, said first radiating element (30), said first feed element (31) and said first ground return element (32) being arranged in order to form a first antenna resonating in a first frequency band, a second radiating element (20), a second feed element (21) connected to said second radiating element and a second ground return element (22) connected to said second radiating element (20) and said first ground return element (32), and said ground section (10), said second radiating element (20), said second feed element (21) and said second ground return element (22) are arranged in order to form a second antenna resonating in a second frequency band; the length ($L_{20}$) of the second radiating element being different from the length ($L_{30}$) of the first radiating element, said second radiating element (20) and said second feed element (21) being offset transversally from said first radiating element (30) and said first feed element (31); wherein the first feed element is connected to the second feed element by a link, such that the second radiating element is connected via the first feed element to a common feeding port (80).

The first antenna and/or the second antenna may be provided in a planar form, for example as a printed planar antenna. In some embodiments of the invention the first and/or second antenna may be formed as an inverted F antenna (PIFA), for example.

In some embodiments, the substrate is provided with a first conductive layer and a second conductive layer separated from each other by said substrate wherein the ground section and the first antenna are provided in the first conductive layer and the second antenna is provided in the second conductive layer.

The two antennas are for example created on a substrate having a top conductive layer and a bottom conductive layer. The radiating element and the feed element of the first antenna may be provided in the top conductive layer and the radiating element and the feed element of the second PIFA are provided in the bottom conductive layer.

The second feed element is preferably connected to the first feed element by a microstrip line printed in the second conductive layer and via a through connection such as a via hole, said microstrip line being arranged below or above the first radiating element.

According to an embodiment of the invention, the first ground return element is connected to the ground section by a through connection, such as a via hole.

According to another embodiment of the invention, the second ground return element is connected to the first ground return element by said a through connection such as a via hole.

In a specific embodiment of the invention, the first radiating element is formed in a straight conductive line.

In another embodiment, the first radiating element comprises first and second successive portions, the second portion being perpendicular to the first portion.

In a specific embodiment of the invention, the length of the first radiating element is greater than the length of the second radiating element such that the second frequency band is higher than the first frequency band.

In a particular embodiment of the invention the link comprises electronic components such as for example, one or more inductors and/or capacitors.

In a particular embodiment of the invention the first feed element comprises electronic components such as for example, one or more inductors and/or capacitors In a particular embodiment of the invention the second feed element comprises electronic components such as for example one or more inductors and/or capacitors.

Advantageously, the length and the width of the first feed element are defined to match the impedance of the first antenna with the impedance of a radio frequency circuit connected to the first feed element.

Advantageously, the first feed element is connected to the radio frequency circuit via an inductor cascaded in series with a capacitor, the inductance of the inductor being determined in order to achieve impedance matching of the second antenna with the radio frequency circuit and the capacitance of the capacitor being determined in order to achieve impedance matching of the first antenna with the radio frequency circuit.

An embodiment of the invention concerns also a multi-band antenna comprising more than two frequency bands.

Accordingly, in a particular embodiment of the invention, the antenna further comprises a third conductive layer of the substrate arranged between first and second conductive layers, said third conductive layer comprising a third radiating element, a third feed element connected to said third radiating element and a third ground return element connected to said third radiating element and said ground section, the length of the third radiating element being different from the lengths of said first and second radiating elements, said third radiating element and said third feed element being offset transversally from said first and second radiating elements, said first and second feed elements and said ground section. Said third radiating element, said third feed element and said third ground return element are arranged in order to form substantially a third antenna, such as a printed inverted F antenna, resonating in a third frequency band.

In this antenna, an antenna, for example a PIFA, is printed in each one of the three conductive layer attached to the substrate.

According to a particular embodiment, the first feed element, the second feed element and the third feed element are connected to a feed port. For example, the second feed element is connected to the third feed element by a first microstrip line printed in the second conductive layer and at least one through connector, such as a via-hole, said first microstrip line being arranged below or above the third radiating element, and the first feed element is connected to the third feed element by a second microstrip line printed in the third conductive layer and at least one through connector, said second microstrip line being arranged below or above the first radiating element.

In another embodiment of the invention, one of said first and second conductive layers further comprises a third radiating element, a third feed element connected to said third radiating element and a third ground return element connected to said third radiating element and said ground section, the length of the third radiating element being different from the lengths of said first and second radiating elements, said third radiating element and said third feed element being offset transversally from said first and second radiating elements, said first and second feed elements and said ground section. Said third radiating element, said third feed element and said third ground return element are arranged in order to form a third antenna, for example a printed inverted F antenna resonating in a third frequency band.

In this embodiment, at least one of the conductive layers comprises at least two antennas.

A further aspect of the invention provides an electronic device for wireless communication comprising a multi band antenna according to any embodiment of the invention. The electronic device may be a gateway device or a set top box, for example.

In a general embodiment of the invention the multi-band antenna is formed from a plurality of antennas, including printed planar antennas such as PIFAs, for example, superimposed and separated by one or more substrate layers.

Embodiments of the invention may provide a multi-band antenna that can be used for example according to the architecture of FIG. 1C.

According to embodiments of the invention a compact low-cost multi-band antenna can be provided, and a multi-band antenna having performances comparable to those of a plurality of single band antennas.

BRIEF DESCRIPTION OF THE DRAWINGS

Embodiments of the invention will now be described, by way of example only, and with reference to the following drawings in which:

FIG. 20 is a schematic view of a first embodiment of a three-band antenna according to the invention;

FIG. 21 is a partial view of FIG. 20;

DETAILED DESCRIPTION OF EMBODIMENTS OF THE INVENTION

The exemplifications set out herein illustrate preferred embodiments of the invention, and such exemplifications are not to be construed as limiting the scope of the invention in any manner.

Figure 1C:
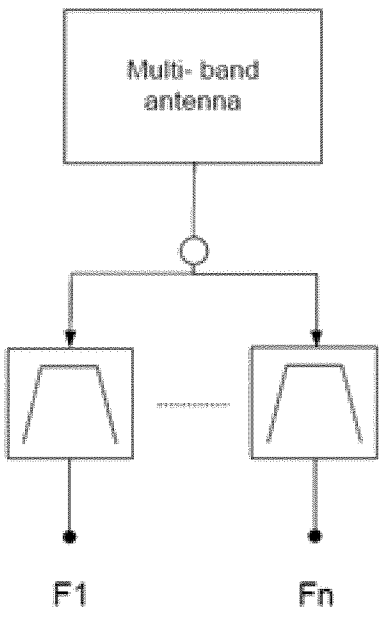
FIG. 1A to FIG. 1C, already described, schematically illustrate examples of antenna architecture for multi-band systems.
Figure 1B:
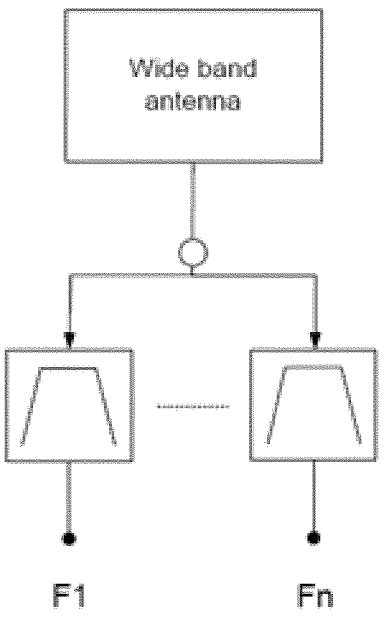
Figure 1A:
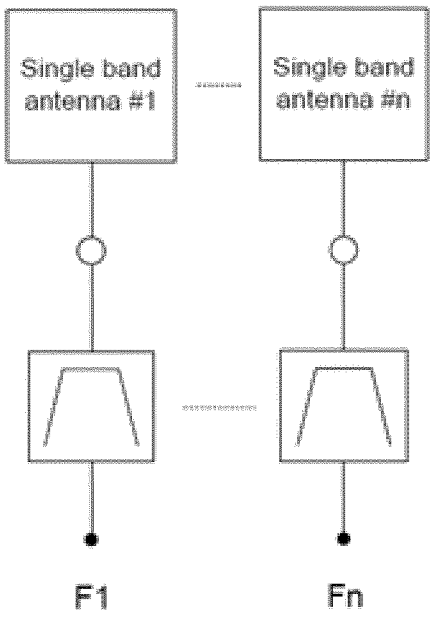
Figure 2:
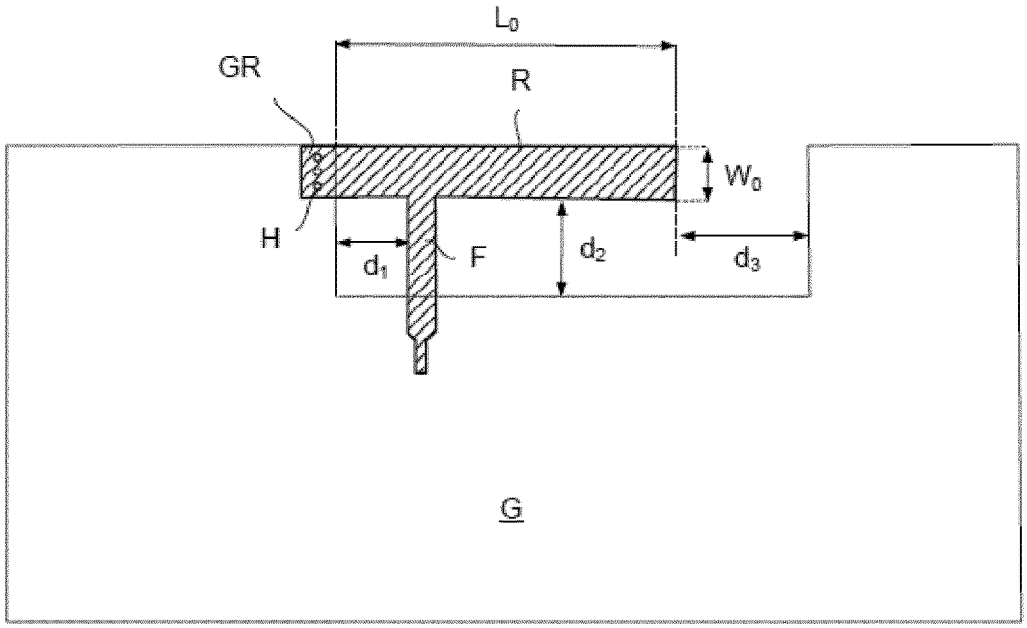
Fig.2 (Prior art)
FIG. 2 is a schematic view of a PIFA of the prior art.

In some embodiments of the invention a multi-band antenna comprising a plurality of antennas such as PIFAs is provided. FIG. 2 illustrates an exemplary design of a single PIFA.

In the particular embodiment of FIG. 2, the PIFA antenna is printed on a substrate having two conductive metal layers: a top layer (in hatched line) on which are printed a feed element F a radiating element R and a ground return element GR, and a bottom layer on which is printed a ground section or ground plane G.

The radiating element R is basically made up of a rectangular line. It can be also meandered to reduce its length. The length $L_0$ of this element is substantially equal to a quarter of the wavelength at the center frequency of the targeted bandwidth of the antenna.

The radiating element R is open-ended at one end and short-circuited to the ground section G by means of the ground return element GR and via-holes H at the other end. The radiating element and the feed element are offset transversally from the ground section G.

The radiating element R is fed by the feed element F which is arranged perpendicularly to the radiating element, both elements together with the ground return element GR form with the vertical edge of the ground plane a kind of inverted-F shape. In this technical field, a PIFA designates an antenna having a substantially inverted F shape or an antenna having a substantially T shape.

Several parameters are adjusted to achieve targeted performances of the antenna:

- the gap $d_1$ between the feed element L and the vertical edge of the ground section G, the feed element width $W_0$ and the gap $d_2$ between the radiating element R and the horizontal edge of the ground plane are defined to match the antenna to the targeted impedance, meeting the requested return loss level.
- the length $L_0$ and the width $W_0$ of the radiating element R and the gap $d_3$ between the end $E_1$ of the radiating element and the right vertical edge of the ground section are defined to achieve the targeted bandwidth and the radiation performances (efficiency, gain).

According to a particular embodiment of the invention, a multi-band antenna based on a plurality of PIFAs which are stacked above each other, is proposed.

FIGS. 3 to 6 illustrate a dual-band antenna according to a first embodiment of the invention.

As for the single PIFA, the dual band antenna is made on a substrate having two conductive metal layers: a top layer (in hatched line) attached to the top surface of the substrate and a bottom layer attached to the bottom layer of the substrate. The bottom layer comprises a ground section 10.

A radiating element 30, a feed element 31 and a ground return element 32 are printed in the top layer. The radiating element 30 and the feed element 31 are offset transversally from the ground section 10. The radiating element 30 has an end connected to the ground section 10 by means of the ground return element 32 and via-holes 60. The other end of the radiating element 30 is open-ended. The feed element 31 is connected perpendicularly to the radiating element 30. The free end of the feed element 31 is connected to a feed port 80.

In this embodiment, the radiating element 30 comprises two successive rectangular portions, a first portion 30A and a second portion 30B which is perpendicular to the portion 30A.

The radiating element 30, the feed element 31 and the ground return element 32 are arranged such that they form a first antenna resonating in a first frequency band B1. In this example the first antenna is formed substantially as a first printed inverted F antenna. The length $L_{30}$ of the radiating element 30 is substantially equal to $\lambda_1/4$, where $\lambda_1$ is the wavelength at the center frequency of the band B1.

In an embodiment of the invention, the bottom layer also comprises a radiating element 20, a feed element 21 and a ground return element 22 forming a second antenna resonating in a second frequency band B2. The ground return element 22 is part of the ground section 10. The ground section 10 is shown in the figures by dots (area with dots). The radiating element 20 and the feed element 21 are offset transversally from the radiating element 30 and the feed element 31 of the top layer.

In this embodiment, the feed elements 21 and 31 are connected together via a link element in the form of a microstrip line 50 printed in the bottom layer and by a through connection passing through the substrate. In this example the through connection is a via-hole 70. In this way, the two feed elements 21 and 31 are connected to the same feed port 80. In particular, the second radiating element 20 is connected to the common feed port 80 via the feed element of the first radiating element 30.

According to a particular embodiment of the invention, the radiating element 20, the feed element 21 and the ground return element 22 are arranged such that they form substantially a second printed inverted F antenna resonating in the second frequency band B2. The length $L_{20}$ of the radiating element 20 is substantially equal to $\lambda_2/4$, where $\lambda_2$ is the wavelength at the center frequency of the band B2.

Figure 6:
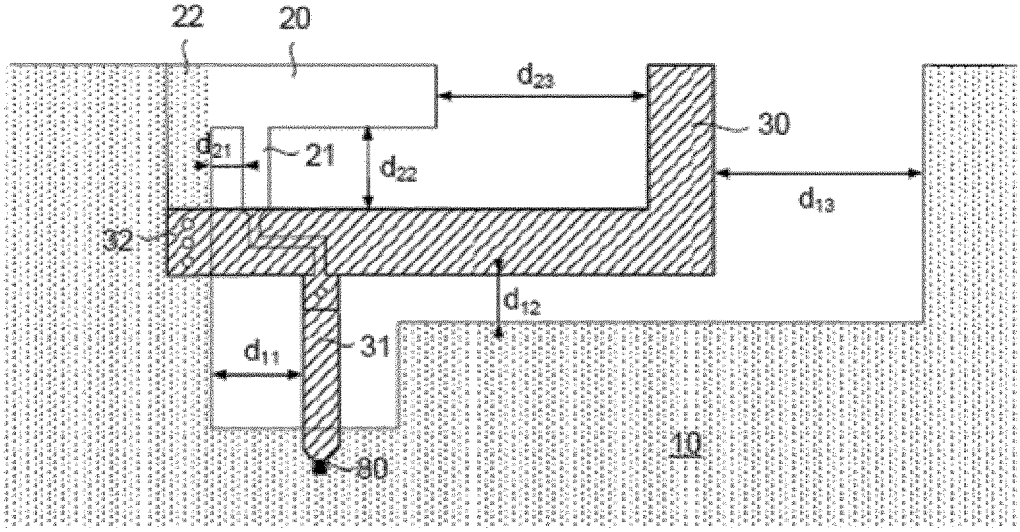
FIG. 6 is a partial view of FIG. 3 showing distances between elements of FIG. 3.

This specific arrangement results in two cascaded antennas, which in the present example are formed as PIFAs, the functionality of which can be relatively independent of one another. Each antenna can be optimized independently of the other. The parameters of the first antenna resonating in the frequency band B1 can be adjusted by acting on the following values:

- the width $W_{30}$ and the length $L_{30}$ of the radiating element 30,
- the width $W_{31}$ of the feed element 31;
- the distance $d_{11}$ between a first vertical edge of the ground section 10 and the feed element 31; this distance is visible on FIG. 6;
- the distance $d_{12}$ between a horizontal edge of the ground section 10 and the portion 30A of the radiating element 30; this distance is visible on FIG. 6; and
- the distance $d_{13}$ between a second vertical edge of the ground section 10 and the portion 30B of the radiating element 30; this distance is visible on FIG. 6.

In the same way, the parameters of the second antenna resonating in the frequency band B2 can be adjusted by acting on the following values:

- the width $W_{20}$ and the length $L_{20}$ of the radiating element 20,
- the width $W_{21}$ of the feed element 21
- the width $W_{50}$ of the microstrip line 50;

the distance $d_{21}$ between the first vertical edge of the ground section 10 and the feed element 21; this distance is visible on FIG. 6;

the distance $d_{22}$ between the radiating element 20 and the portion 30A of the radiating element 30; this distance is visible on FIG. 6; and the distance $d_{23}$ between the open end of the radiating element 20 and the portion 30B of the radiating element 30; this distance is visible on FIG. 6.

In the present embodiment, the length $L_{30}$ of the PIFA resonating in the frequency B1 is greater than the length $L_{20}$ of the PIFA resonating in the frequency B2 such that the frequency band B1 is lower than the band B2.

In this embodiment, the PIFA constituted by the radiating element 30, the feed element 31 and the ground return element 32 forms the lower band PIFA and the PIFA constituted by the radiating element 20, the feed element 21 and the ground return element 22 forms the higher band PIFA.

The width $W_{33}$, the distance $d_{ii}$ and the length $L_{31}$ of the feed element 31 are defined to match the impedance of the PIFA resonating in frequency Band B1 with the impedance of a radio frequency circuit connected to the feed port.

The width $W_{31}$ and the length $L_{31}$ of the feed element 31 together with the width $W_{21}$ and the length $L_{21}$ of the feed element 21, the width $W_{50}$ of the microstrip line 50 and the distance $d_{21}$ are defined to match the impedance of the PIFA resonating in frequency Band B2 with the impedance of a radio frequency circuit connected to the feed port.

Figure 7:
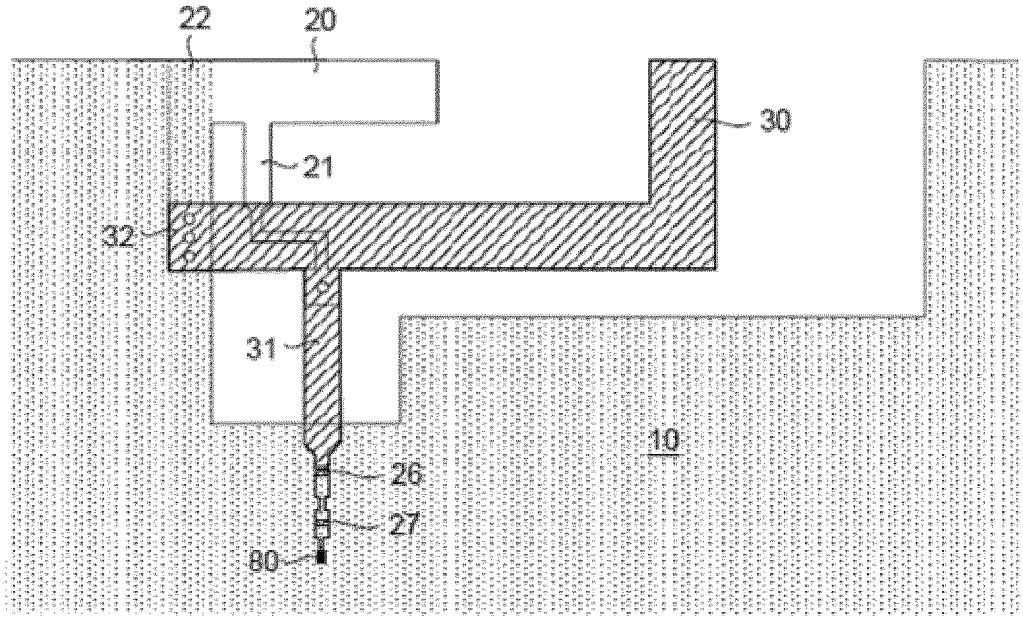
FIG. 7 schematically illustrates a second embodiment of a dual-band antenna according to the invention.

In a preferred embodiment illustrated by FIG. 7, the feed port 80 is connected to the radio frequency circuit via an inductor 26 cascaded in series with a capacitor 27, the inductance of the inductor 26 being determined in order to achieve impedance matching of the PIFA resonating in the higher band (band B2) with the radio frequency circuit and the capacitance of the capacitor 27 being determined in order to achieve impedance matching of the PIFA resonating in the lower band (band B1) with the radio frequency circuit.

Figure 8:
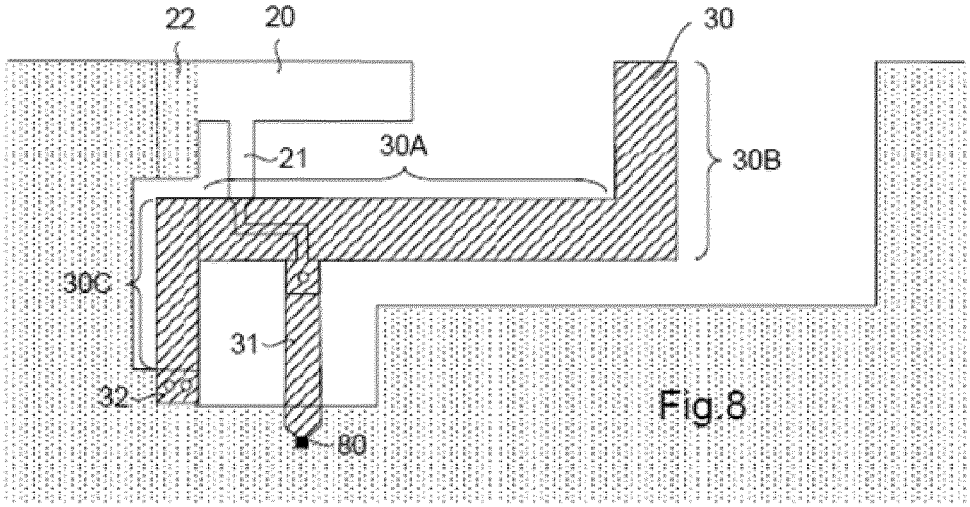
FIG. 8 schematically illustrates a third embodiment of a dual-band antenna according to the invention.
Figure 9:
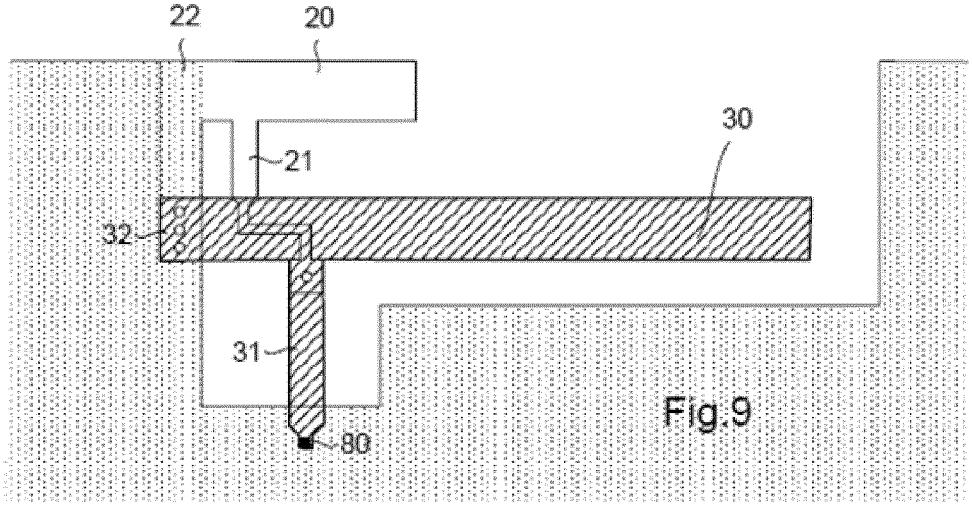
FIG. 9 schematically illustrates a fourth embodiment of a dual-band antenna according to the invention.
Figure 10:
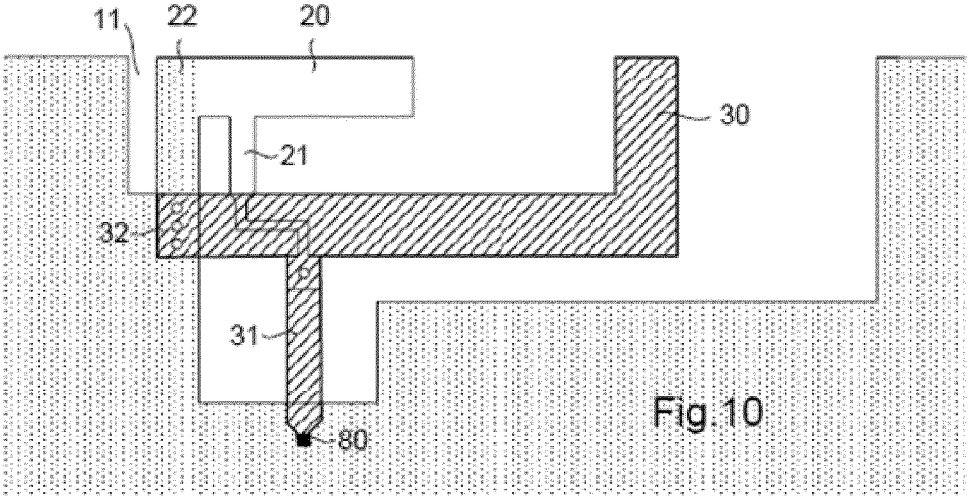
FIG. 10 schematically illustrates a fifth embodiment of a dual-band antenna according to the invention.

Variants of the first embodiment are illustrated by FIGS. 8 to 10.

In a variant shown at FIG. 8, the radiating element 30 comprises a third elongated portion 30C, formed relatively straight and connected perpendicularly to the central portion 30A at the opposite of the portion 30B, the portions 30B and 30C extending in opposite directions. The via-holes 35 are placed at the free end of the portion C.

As a variant, the radiating element 30 may not be formed relatively straight, for example the radiating element may comprise a plurality of straight portions forming meanders.

In another variant illustrated by FIG. 9, the radiating element 30 comprises a single straight portion.

In another variant illustrated by FIG. 10, a slot 11 is etched in the bottom layer in order to achieve for instance a narrower bandwidth in the higher frequency band.

This dual-band antenna can be for example a WLAN dual-band 2.4/5 GHz antenna. This antenna is for example printed onto a FR-4 substrate, the thickness of which is 1.2 mm. In this case, it is possible to achieve a dual-band PIFA size of 22×8 $mm^2$ onto PCB size of 240×142 $mm^2$.

The performances of such an antenna have been simulated by the HFSS™ 3D-EM simulation tool and are presented below. The simulated dual-band antenna comprises, at its input, an inductor 26 of 2.5 nH cascaded with a capacitor 27 of 0.7 pF.

Figure 11:
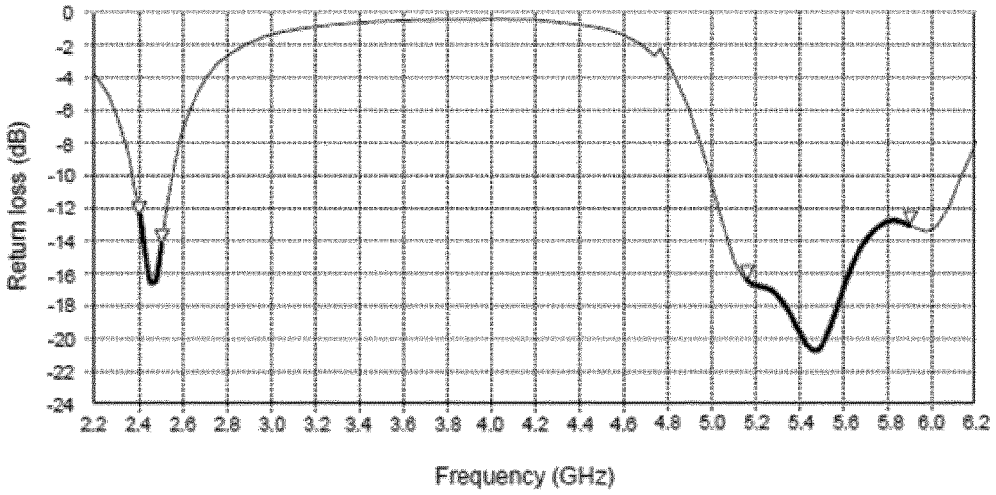
FIG. 11 is a graphically illustrates the return loss of a dual-band antenna as illustrated by FIG. 7 operating in the WLAN 2.4 GHz and 5 GHz bands.

The performances of this antenna are illustrated by FIGS. 11 to 19. FIG. 11 shows that the return loss levels are lower than the commonly required level (−10 dB), in both bands [2.4 GHz-2.5 GHz] and [5.15 GHz-5.85 GHz].

Figure 12:
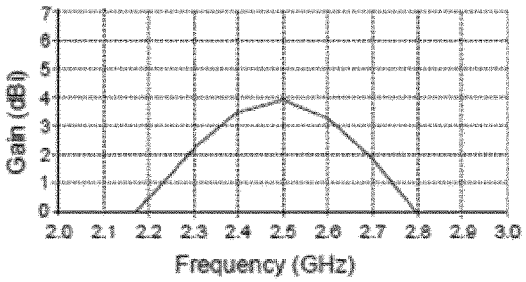
FIG. 12 and FIG. 13 graphically illustrate, for a dual-band antenna as illustrated by FIG. 7 operating in the WLAN 2.4 GHz and 5 GHz bands, the gain in the 2.4 GHz band and in the 5 GHz band respectively.
Figure 13:
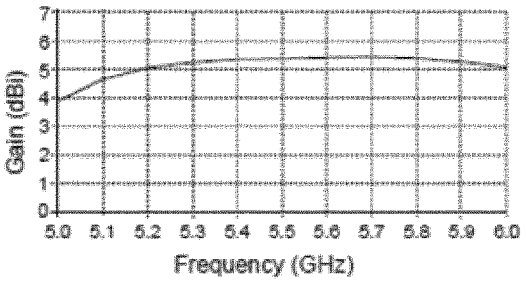

FIG. 12 and FIG. 13 show that the simulated gain is at a fair level, at around 4 dBi and 5 dBi in the 2.4 GHz and 5 GHz bands respectively.

Figure 14:
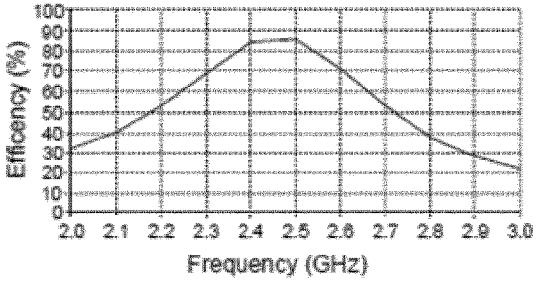
FIG. 14 and FIG. 15 graphically illustrate, for a dual-band antenna as illustrated by FIG. 7 operating in the WLAN 2.4 GHz and 5 GHz bands, the antenna efficiency in the 2.4 GHz band and in the 5 GHz band respectively.
Figure 15:
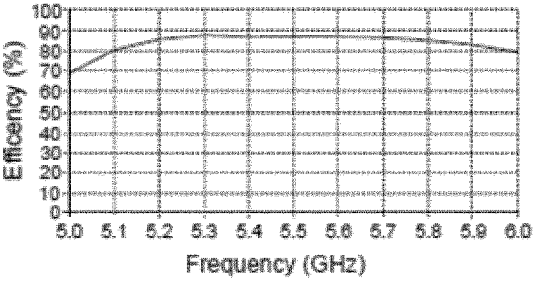

FIG. 14 and FIG. 15 show that the antenna exhibits a high efficiency in both frequency bands, around 80-85%.

Figure 16:
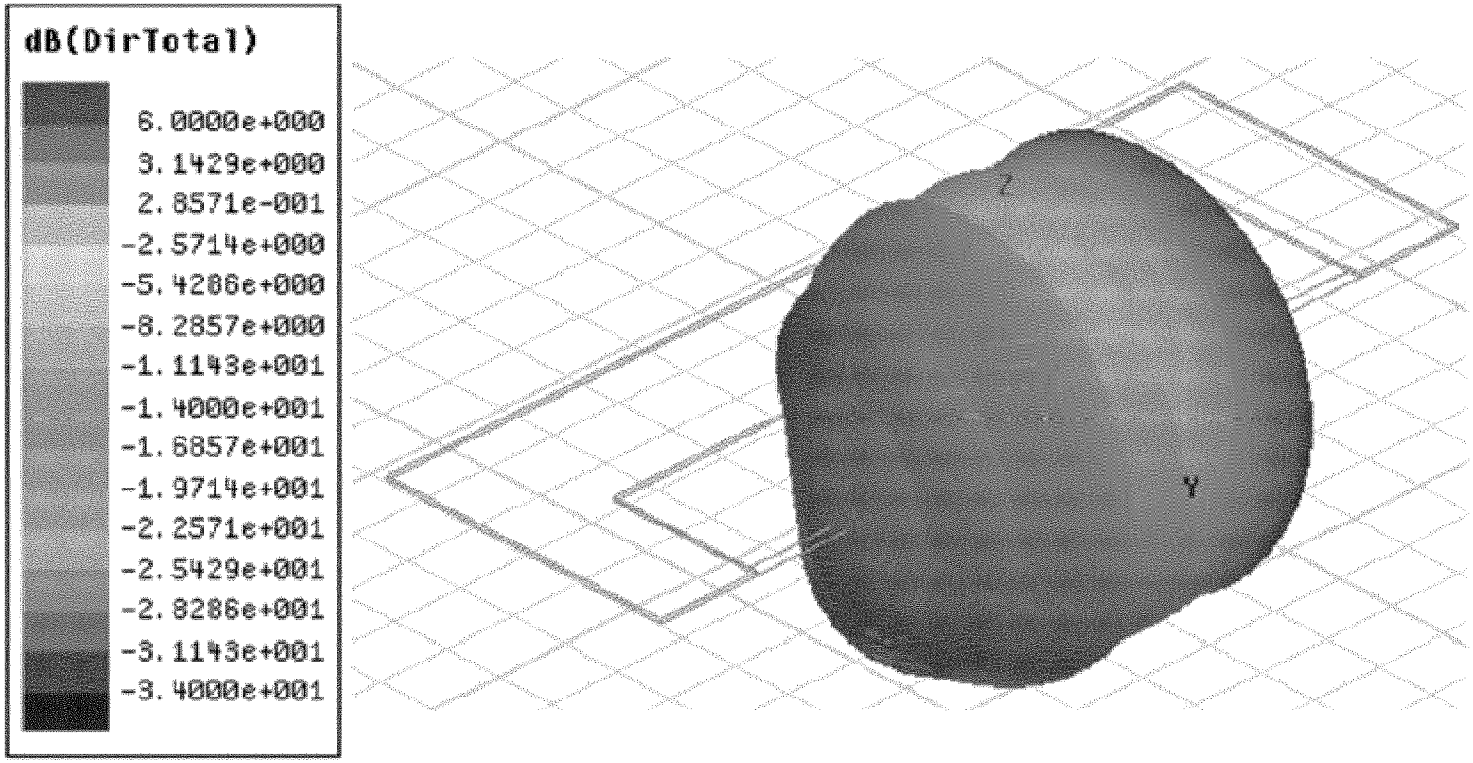
FIG. 16 and FIG. 17 represent, for a dual-band antenna as illustrated by FIG. 7 operating in the WLAN 2.4 GHz and 5 GHz bands, the 3D radiation pattern at 2.45 GHz and 5.5 GHz respectively.
Figure 17:
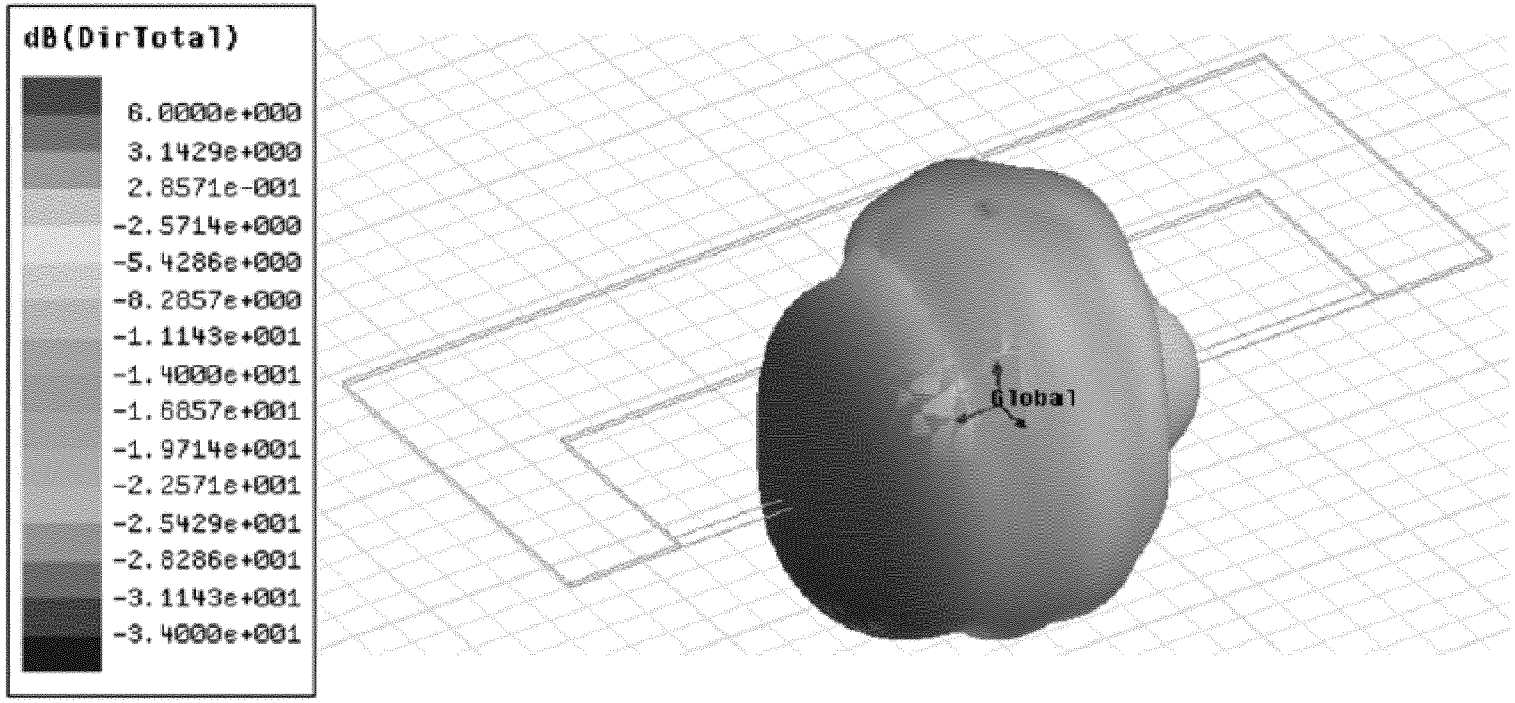

FIG. 16 and FIG. 17 show the 3D radiation patterns at 2.45 GHz and 5.5 GHz respectively. They are similar to what can exhibit a single band PIFA, with a radiation directed mainly to the front-side.

Figure 18:
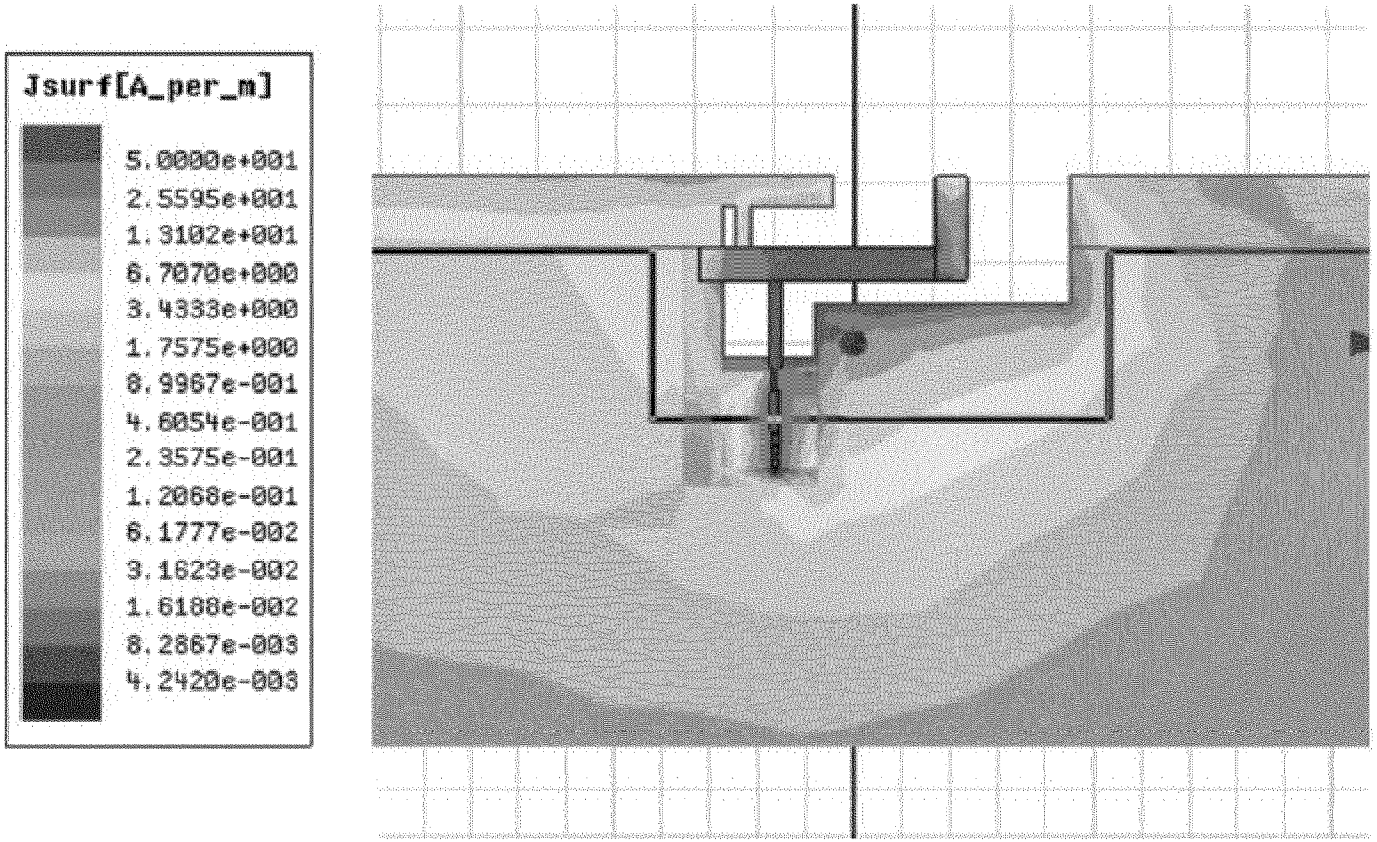
FIG. 18 and FIG. 19 represent, for a dual-band antenna as illustrated by FIG. 7 operating in the WLAN 2.4 GHz and 5 GHz bands, the current distributions at a frequency of 2.45 GHz and a frequency of 5.5 GHz respectively.
Figure 19:
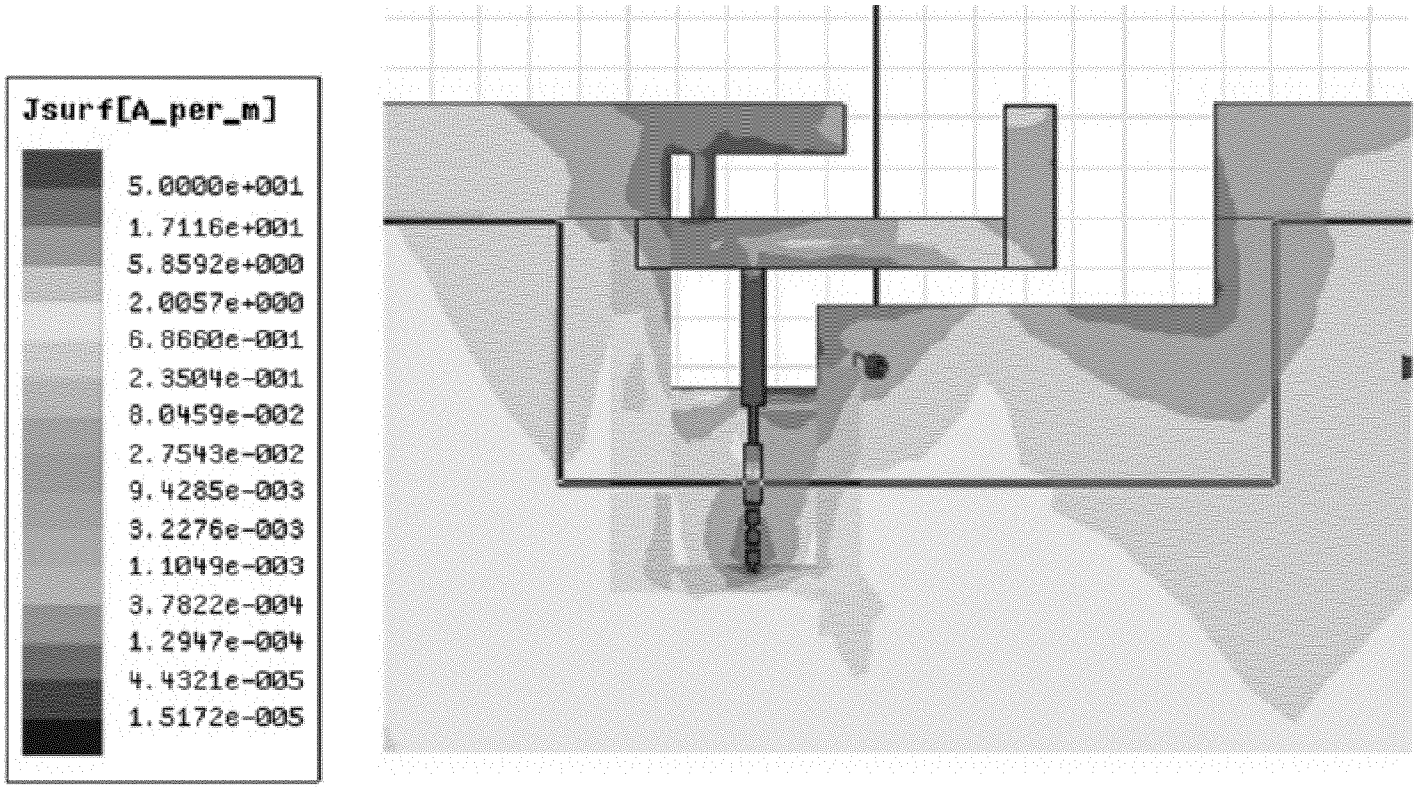

FIG. 18 and FIG. 19 show of the current distributions at 2.45 GHz and 5.5 GHz respectively. FIG. 18 points out that the radiating element 20, which resonates in the higher band, is not very activated, demonstrating by this way that this element is quite transparent in the 2.4 GHz band. When exciting the antenna in the higher band at 5.5 GHz, FIG. 19 shows that the radiating element 20 is resonating while the radiating element 30 drives the residual current, as also the ground plane surrounding it.

This topology of cascaded antennas can be extended to a multi-band antenna having more than two frequency bands. For example, it can be used for designing a 3-band antenna as illustrated by FIGS. 20 and 21.

The antenna of FIGS. 20 and 21 comprises a multi-layered substrate and three superimposed conductive layers, each one of these conductive layers being separated from an adjacent conductive layer by a substrate layer. These conductive layers are defined as bottom layer, intermediate layer and top layer. The bottom layer comprises the ground section 10.

Figure 3:
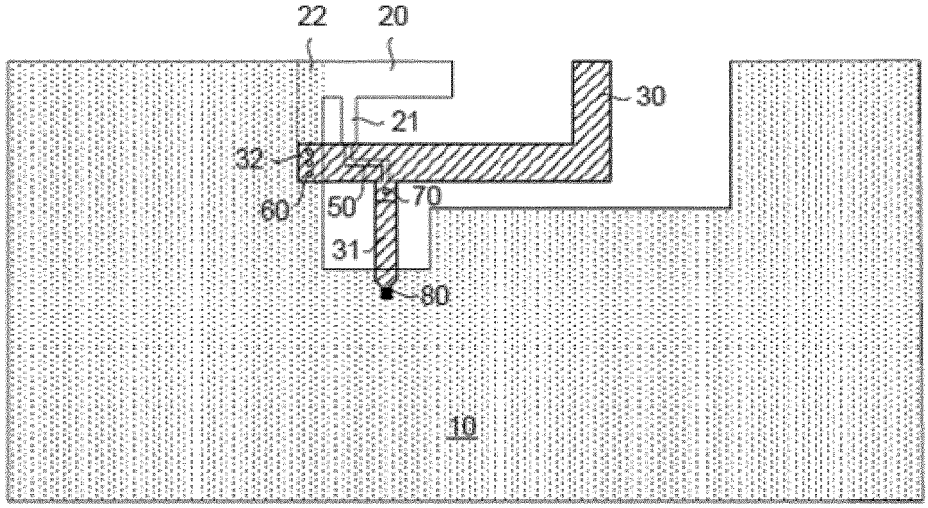
FIG. 3 is a schematic view of a first embodiment of a dual-band antenna according to the invention.
Figure 4:
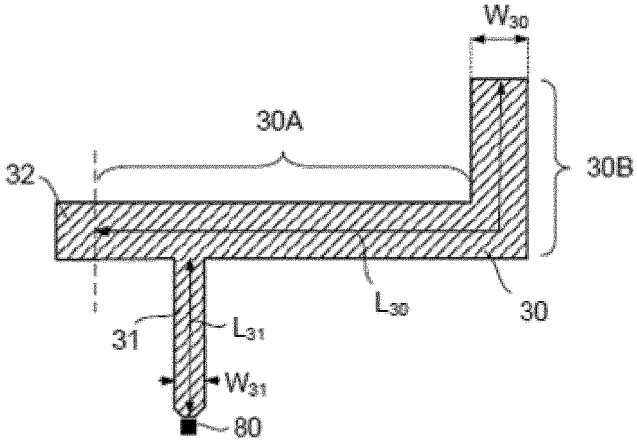
FIG. 4 is a partial view of FIG. 3 showing a first radiating element and a first feed element of the antenna of FIG. 3.
Figure 5:
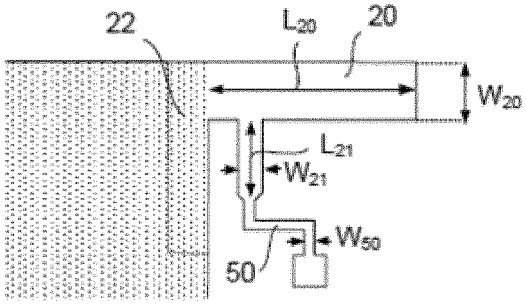
FIG. 5 is a partial view of FIG. 3 showing a second radiating element and a second feed element of the antenna of FIG. 3.

Compared to the dual-band antenna of FIG. 3, the antenna of FIGS. 20 and 21 comprises an additional antenna, for example formed as a PIFA antenna, resonating in a frequency band B3 different from B1 and B2 printed in the intermediate layer.

The top layer comprises a first PIFA made of the radiating element 30, the feed element 31 and the ground return element 32. The bottom layer comprises a second PIFA made of the radiating element 20, the feed element 21 and the ground return element 22. And the intermediate layer comprises a third PIFA made of a radiating element 40, a feed element 41 and a ground return element 42.

As for the dual-band antenna of FIG. 3, the radiating element 30 is connected to the ground section 10 by means of the ground return element 32 and the via-holes 60. The radiating element 40 is connected to ground section 10 by means of the ground return element 42 and the via-holes 61. The ground return element 22 is connected to the ground return 42 by said via-holes 61.

The feed element 21 is connected to the feed element 41 by means of a microstrip line 50*a* printed in the bottom layer and via-holes 70*a* and the feed element 41 is connected to the feed element 31 by means of a microstrip line 50*b* printed in the intermediate layer and via-holes 70*b*.

In this embodiment, as the length of the radiating element 20 is lower than the length of the radiating element 40 which is itself lower than the length of the radiating element 30, the radiating element 30 resonates in a lower frequency band, the radiating element 40 resonates in an intermediate frequency band and the radiating element 20 resonates in a higher frequency band.

Figure 22:
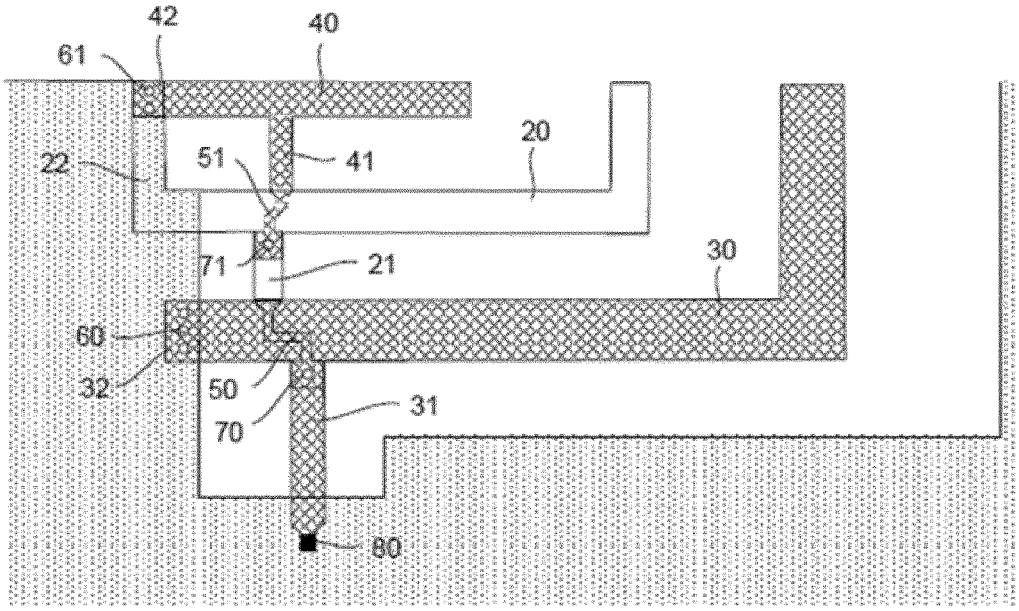
FIG. 22 is a schematic view of a second embodiment of a three-band antenna according to the invention.

This topology of cascaded PIFAs can be extended to n-band antennas. In this embodiment, each conductive layer comprises a single PIFA. In a variant of 3-band antenna illustrated by FIG. 22, one of the conductive layers comprises two PIFAs. The 3-band antenna comprises only two conductive layers, a bottom layer and a top layer. The PIFA made of the radiating element 20, the feed element 21 and the ground return element 22 is printed in the bottom layer and the two other PIFAs made of the radiating elements 30, 40, the feed elements 31, 41 and the ground return elements 32, 42 are printed in the top layer.

As for the three-band antenna of FIG. 20, the radiating element 30 is connected to the ground section 10 by means of the ground return element 32 and the via-holes 60. The radiating element 40 is connected to ground section 10 by means of the ground return element 42 and the via-holes 61. These elements are made in the top layer.

The radiating element 20, the feed element 21 and the ground return element 22 made in the bottom layer are placed between the radiating element 40 and the radiating element 30.

The ground return element 22 is directly connected to the ground section 10.

The feed element 41 is connected to the feed element 21 by means of a microstrip line 51 printed in the top layer and via-holes 71 and the feed element 21 is connected to the feed element 31 by means of a microstrip line 50 printed in the bottom layer and via-holes 70.

While in the previous embodiments the link element connecting the feed element of the second antenna to the feed element of the first antenna comprises a microstrip line, in other embodiments of the invention at least part of the link element may be composed of one or more electronic components, such as for example one or more inductors and/or capacitors. Moreover, at least part of the first and/or second feed element may be composed of one or more of such electronic components.

Figure 23:
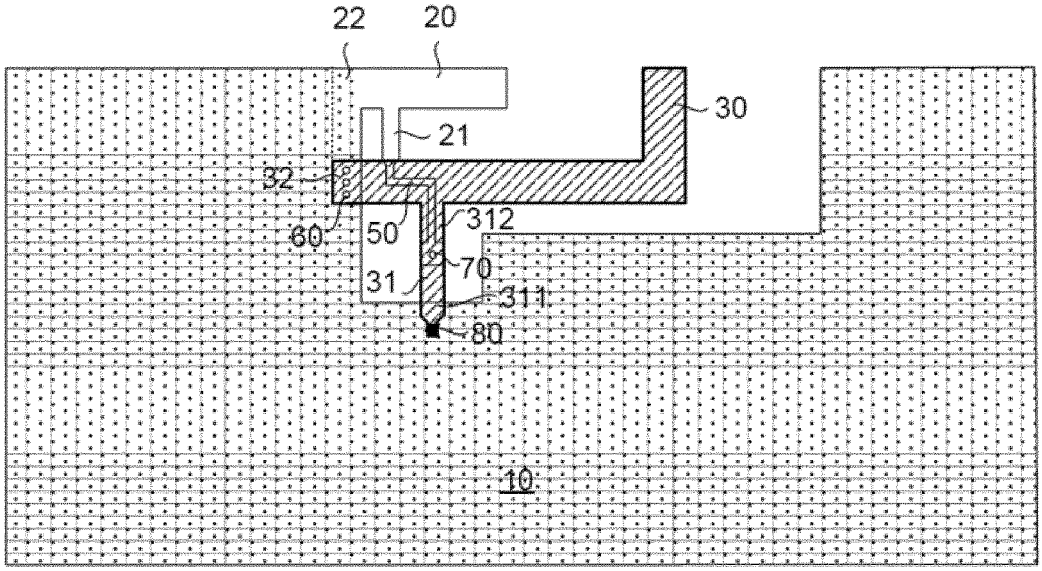
FIG. 23 is a schematic view of a further embodiment of a dual-band antenna according to the invention.

FIG. 23 illustrates an embodiment of the invention in which one or more electronic components such as inductors and/or capacitors are provided along the path of the first feed element 31 by the link element 50. In this example the link element 50 extends along a section 312 of the first feed element 31 from the radiating element 30. One or more inductors and/or capacitors are included on this part of the link element 50 overlapping section 312 of the feed element 31. In this way the first feed line is adapted before the first radiating element 30.

Such a configuration may be applied for example in an LTE application in which the frequency bandwidth is wide-adaptation of the antenna for a radiating element may be made on the feed line before the first radiating element. In other embodiments the electronic components may be provided on the feed element 31.

An electronic device with a plurality of wireless functionalities may thus be provided with a multi-band antenna in accordance with an embodiment of the invention. The electronic device may be for example a gate-way device, a set-top box or a mobile wireless device operating in accordance with different wireless standards.

This topology of a multi-band antenna in accordance with embodiments of the invention presents the following advantages:

- Its compactness enabling surface area occupied by the numerous antennas in the PCB to be reduced;
- size reduction enabling the PCB cost to be reduced.
- despite its compactness, the achieved performances are comparable to multi-single antenna performances; and
- it is an easy way to optimize the design to achieve the targeted performance that enables to reduce the time to market.

Although the present invention has been described hereinabove with reference to specific embodiments, the present invention is not limited to the specific embodiments, and modifications will be apparent to a skilled person in the art which lie within the scope of the present invention.

For instance, while the foregoing examples have been described with respect to a printed inverted F antenna (PIFA) it will be appreciated that the invention may be applied to other suitably shaped antennas.

Moreover, while the described embodiments relate to antenna elements being provided on separate conductive layers of a substrate, for example on opposing surfaces, it will be appreciated that in alternative embodiments of the invention a plurality of antennas may be provided on the same surface of a substrate.

Many further modifications and variations will suggest themselves to those versed in the art upon making reference to the foregoing illustrative embodiments, which are given by way of example only and which are not intended to limit the scope of the invention, that being determined solely by the appended claims. In particular the different features from different embodiments may be interchanged, where appropriate.

The invention claimed is:

1. A multi-band antenna comprising:

a substrate having at least one conductive layer;

said at least one conductive layer comprising a ground section;

a first radiating element, a first feed element connected to said first radiating element and a first ground return element connected to said first radiating element and said ground section, said first radiating element and said first feed element being offset transversally from the ground section, said first radiating element, said first feed element and said first ground return element being arranged to form a first antenna resonating in a first frequency band, a second radiating element, a second feed element connected to said second radiating element and a second ground return element connected to said second radiating element and said first ground return element, and said ground section, said second radiating element, said second feed element and said second ground return element are arranged to form a second antenna resonating in a second frequency band;

the length L20 of the second radiating element being different from the length L30 of the first radiating element, said second radiating element and said second feed element being offset transversally from said first radiating element and said first feed element; wherein the first feed element is connected to the second feed element by a link, such that the second radiating element is connected via the first feed element to a common feeding port; and a third conductive layer of the substrate arranged between first and second conductive layers, said third conductive layer comprising a third radiating element, a third feed element connected to said third radiating element and a third ground return element connected to said third radiating element and said ground section, the length $L_{40}$ of the third radiating element being different from the lengths $L_{30}$, $L_{20}$ of said first and second radiating elements, said third radiating element and said third feed element being offset transversally from said first and second radiating elements, said first and second feed elements and said ground section, wherein said third radiating element, said third feed element and said third ground return element being arranged to form a third antenna resonating in a third frequency band.

2. The multi-band antenna according to claim 1 wherein the substrate is provided with a first conductive layer and a second conductive layer separated from each other by said substrate wherein the ground section and the first antenna are provided in the first conductive layer and the second antenna is provided in the second conductive layer.

3. The multi-band antenna according to claim 2, wherein the link comprises a microstrip line printed in the second conductive layer and is connected to the first conductive layer by at least one through connector, said microstrip line being arranged below or above the first radiating element.

4. The multi-band antenna according to a claim 1, wherein the first ground return element is connected to the ground section by at least one through connector.

5. The multi-band antenna according to claim 4, wherein the second ground return element is connected to the first ground return element by said at least one through connector.

6. The multi-band antenna according to claim 1, wherein the first radiating element is a straight conductive line.

7. The multi-band antenna according to claim 1, wherein the first radiating element comprises first and second successive straight portions the second portion) being perpendicular to the first portion.

8. The multi-band antenna according to claim 1, wherein the length $L_{30}$ of the first radiating element is greater than the length $L_{20}$ of the second radiating element such that the second frequency band is higher than the first frequency band.

9. The multi-band antenna according to claim 1, wherein the length $L_{31}$ and the width $W_{31}$ of the first feed element are defined to match the impedance of the first antenna with the impedance of a radio frequency circuit connected to the first feed element.

10. The multi-band antenna according to claim 9, wherein the first feed element is connected to the radio frequency circuit via an inductor cascaded with a capacitor, the inductance of the inductor being determined in order to achieve impedance matching of the second antenna with the radio frequency circuit and the capacitance of the capacitor being determined in order to achieve impedance matching of the first antenna with the radio frequency circuit.

11. The multi-band antenna according to claim 1, wherein the first feed element, the second feed element and the third feed element are connected to a feed port.

12. The multi-band antenna according to claim 11, wherein the second feed element is connected to the third feed element by a first microstrip line printed in the second conductive layer and at least one through connector, said first microstrip line being arranged below or above the third radiating element, and the first feed element is connected to the third feed element by a second microstrip line printed in the third conductive layer and at least one through connector, said second microstrip line being arranged below or above the first radiating element.

13. The multi-band antenna according to claim 1, wherein one of said first and second conductive layers further comprises a third radiating element, a third feed element connected to said third radiating element and a third ground return element connected to said third radiating element and said ground section, the length of the third radiating element being different from the lengths of said first and second radiating elements, said third radiating element and said third feed element being offset transversally from said first and second radiating elements, said first and second feed elements and said ground section, said third radiating element, said third feed element and said third ground return element being arranged to form a third F antenna resonating in a third frequency band.

14. The multi-band antenna according to claim 1 wherein the first antenna, the second antenna and/or the third antenna is formed as an inverted F antenna.

15. The multi-band antenna according to claim 1 wherein at least part of the first feed element, the second feed element and/or the link includes one or more electronic components.

16. An electronic device for wireless communication comprising a multi-band antenna according to claim 1.

* * * * *